US007090550B2

(12) United States Patent
Wilkie

(10) Patent No.: US 7,090,550 B2
(45) Date of Patent: Aug. 15, 2006

(54) PROPELLER WITH VARIABLE GEOMETRY AND METHOD FOR VARYING GEOMETRY OF A PROPELLER

(75) Inventor: Geoffrey D. M. Wilkie, Mountain View, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/763,559

(22) Filed: Jan. 23, 2004

(65) Prior Publication Data

US 2004/0185725 A1 Sep. 23, 2004

Related U.S. Application Data

(60) Provisional application No. 60/442,129, filed on Jan. 24, 2003.

(51) Int. Cl.
*B63H 1/22* (2006.01)
*B64C 11/28* (2006.01)
*B64C 27/50* (2006.01)

(52) U.S. Cl. ..... 440/49; 416/88; 416/142

(58) Field of Classification Search ..... 440/49, 440/50; 416/87, 88, DIG. 5, 142, 143; 244/218, 244/219

See application file for complete search history.

(56) References Cited

U.S. PATENT DOCUMENTS

| | | | | |
|---|---|---|---|---|
| 2,716,460 | A * | 8/1955 | Young | 416/24 |
| 2,852,207 | A * | 9/1958 | Jovanovich | 244/7 R |
| 2,885,012 | A * | 5/1959 | Heintzelman | 416/88 |
| 2,996,121 | A * | 8/1961 | Stub | 416/88 |
| 3,249,160 | A * | 5/1966 | Messerschmitt | 416/174 |
| 5,024,031 | A | 6/1991 | Hoberman | |

FOREIGN PATENT DOCUMENTS

JP 08142987 A * 6/1996

OTHER PUBLICATIONS

U.S. Appl. No. 10/613,172, Filed Jul. 3, 2003 (Wilkie).

* cited by examiner

*Primary Examiner*—Ajay Vasudeva
(74) *Attorney, Agent, or Firm*—Simpson & Simpson, PLLC

(57) ABSTRACT

The present invention broadly comprises a propeller having a blade assembly with a plurality of linking members operatively connected to change dimensions of the blade assembly as the linking members are moved with respect to one another. It further includes a blade surface operatively arranged to cover at least a portion of the blade assembly and to change shape in response to the changes in the dimensions for the blade assembly.

26 Claims, 13 Drawing Sheets

PROPELLER WITH VARIABLE GEOMETRY AND METHOD FOR VARYING GEOMETRY OF A PROPELLER

CROSS-REFERENCE TO RELATED APPLICATIONS

This application claims the benefit under 35 U.S.C. §119 (e) of U.S. Provisional Application No. 60/442,129, filed Jan. 24, 2003.

FIELD OF THE INVENTION

This invention relates to the construction of propellers. More specifically it relates to a propeller having propeller blades with variable dimensions. Even more specifically, the present invention relates to an aircraft or waterborne or submersible craft having a propeller whose size and shape can be modified.

BACKGROUND OF THE INVENTION

Aircraft and waterborne and submersible vessels are typically constructed having propellers of fixed dimensions. The dimensions chosen affect the amount of force created by the propeller per unit torque on the propeller shaft. A greater diameter is desired for many applications. However, a fixed diameter propeller is limited in size by, for example, the need for an aircraft to land and for a waterborne or submersible craft to enter port.

Clearly, then, there is a longfelt need for a vessel having a propeller with variable dimensions.

SUMMARY OF THE INVENTION

The present invention broadly comprises a propeller having a blade assembly with a plurality of linking members operatively connected to change dimensions of the blade assembly as the linking members are moved with respect to one another. It further includes a blade surface operatively arranged to cover at least a portion of the blade assembly and to change shape in response to the changes in the dimensions for the blade assembly.

A general object of the present invention is to provide a propeller having variable dimensions.

Another object of the present invention is to provide a propeller blade having variable dimensions.

Yet another object of the present invention is to provide a propeller having a variable shape.

Still another object of the present invention is to provide a propeller blade having a variable shape.

These and other objects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE PREFERRED EMBODIMENT

It should be appreciated that, in the detailed description of the invention that follows, like reference numbers on different drawing views are intended to identify identical or similar structural elements of the invention in the respective views.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

The invention broadly comprises a propeller with a blade assembly having variable dimensions. The invention further comprises an adjustable blade surface that changes size and shape and covers at least a portion of the blade assembly. The blade assembly may be a radial extension/retraction truss structure as disclosed by U.S. Pat. No. 5,024,031 (Hoberman), incorporated by reference herein.

Figure 1:
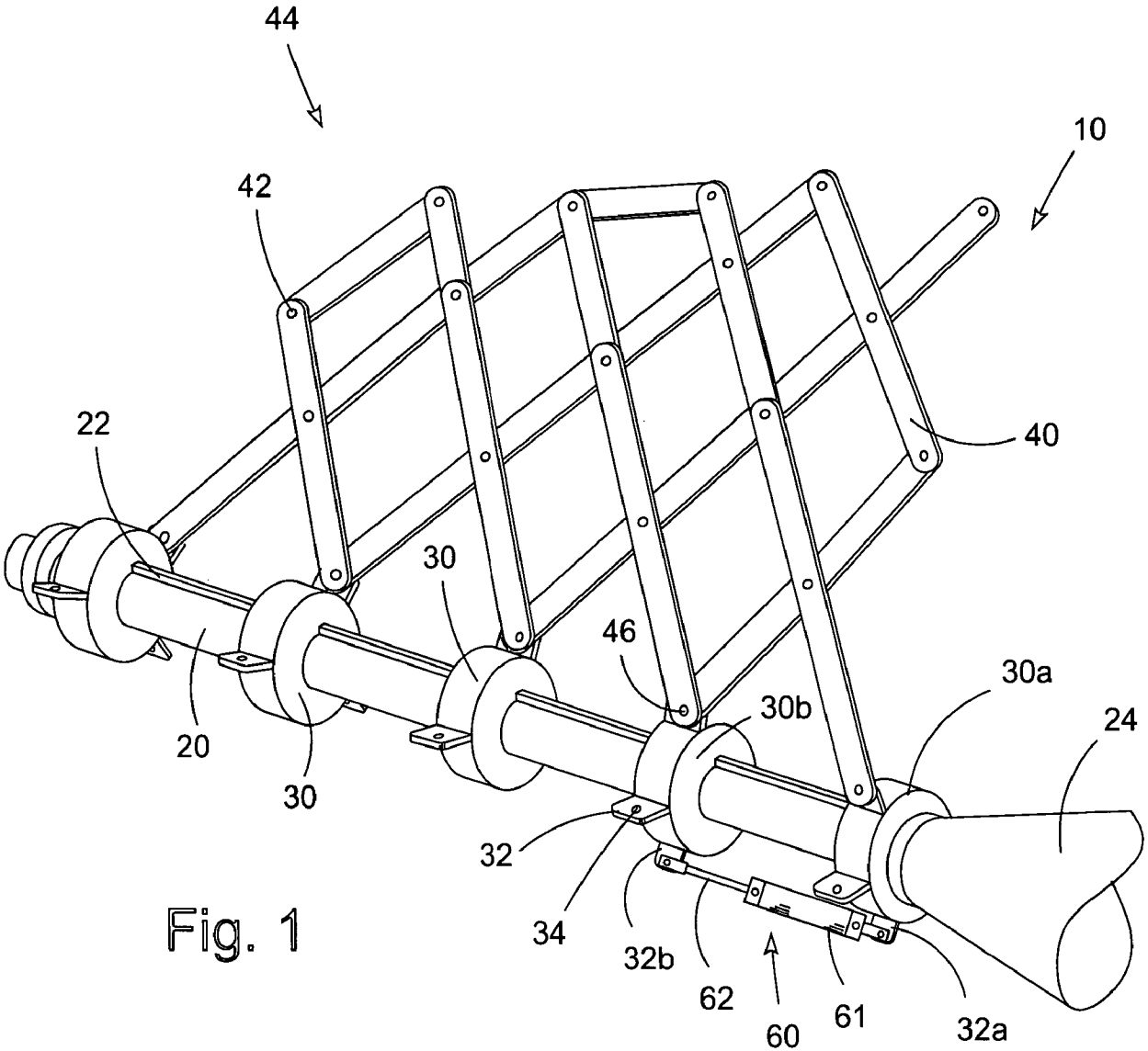
FIG. 1 is a perspective view of the present invention propeller in an expanded configuration.

FIG. 1 is a perspective view of the present invention propeller 10 in an expanded configuration. Shaft 20 includes a key 22 running the length of shaft 20. However, any number of key members may be used. Shaft 20 is connected to member 24, which delivers torque from a vehicle power plant (not shown) to shaft 20. Collars 30 radially surround shaft 20 and include a slot that engages key 22, preventing collars 30 from rotating about shaft 20 as power is applied to member 24 to rotate shaft 20. However, it should be readily apparent to one skilled in the art that other means of preventing rotation of collars 30 may be used, and such means are within the spirit and scope of the invention as claimed. Collars 30 can slide longitudinally along shaft 20.

Each collar 30 has a collar extension 32 with aperture 34. Respective extensions 32 can be located at various radial angles with respect to a radial axis for shaft 20. The angles can be varied to provide a desired blade pitch, as further described below. However, it should be readily apparent to one skilled in the art that other angle configurations are possible, and such configurations are within the spirit and scope of the invention as claimed.

Lattice bars, or linking members, 40 are substantially straight in shape and have a plurality of pivoting connection points 42, aligned in a straight line. It should be readily apparent to one skilled in the art that other shapes are possible for bars 40, and that such shapes are within the spirit and scope of the invention as claimed. Collectively, bars 40 form folding lattice 44. Folding lattice 44 is pivotally connected to respective collar extensions 32 using fasteners 46 that extend through apertures (not shown) in bars 40 and apertures 34 in collar extensions 32. The connection between collars 30 and bars 40 may have a generous tolerance or may pivot or fold to allow a small amount of rotation about an axis radial from shaft 20 and through the connection. Folding lattice 44 forms the basic structure for a propeller blade as is further described below. Bars 40 may be identical for efficiency of production, or individually designed for operation efficiency or strength, with different cross sections to better approximate typical foil sections when assembled.

FIG. 1 shows each collar 30 with three collar extensions 32, corresponding to attachment points for three folding lattice 44 assemblies (only one of which is shown). To simplify this presentation, only one folding lattice assembly is shown in FIG. 1. It should be readily apparent to one skilled in the art that any number of collar extensions may be used on collars 30, and that such number of collar extensions is within the spirit and scope of the invention as claimed. Linear actuator 60 is substantially parallel to the longitudinal axis of shaft and is connected to collar extensions 32*a* and 32*b*. However, it should be readily apparent to one skilled in the art that actuator 60 can be connected to other or additional collars extensions 32, and such connections are within the spirit and scope of the invention as claimed. Collar extensions 32*a* and 32*b* are connected to collars 30*a* and 30*b*, respectively. Actuator 60 has a body 61 connected to collar extension 32*a* and a shaft 62 connected to collar extension 32*b*. Actuator 60 moves shaft 62 substantially parallel to the longitudinal axis of shaft 20. That is, the actuator 60 extends or withdraws shaft 62 with respect to body 61. In FIG. 1, shaft 62 is extended. Movement of shaft 62 causes movement of collars 30*a* and 30*b* and subsequently, movement of bars 40. For example, in FIG. 1, shaft 62 is extended, causing collars 30*a* and 30*b* to move further apart along shaft 20. This movement of collars 30*a* and 30*b*, in turn, causes bars 40 to unfold, changing the configuration of folding lattice 44. Specifically, the width of folding lattice 44 (measured substantially parallel to the longitudinal axis of shaft 20) increases and the length of folding lattice 44 (measured substantially parallel to a radial axis of shaft 20) decreases. It should be readily apparent to one skilled in the art that additional actuators may be used, and the use of such additional actuators is within the spirit and scope of the invention as claimed. The actuator 60 can be a pneumatic or hydraulic device or a micro-electrical-mechanical system (MEMS), or any other means known in the art. It should be understood that actuator 60 also could be directly connected to lattice bars 40 (not shown). The collars 30 then slide along shaft 20 responsive to the motion of the lattice bars. A rotational actuator may be similarly powered to rotate any adjacent or set of adjacent lattice bars 40 at their common pivot points 42. In addition, a multiplicity of actuators can be used and combinations of linear and rotational actuators also are possible.

Figure 1A:
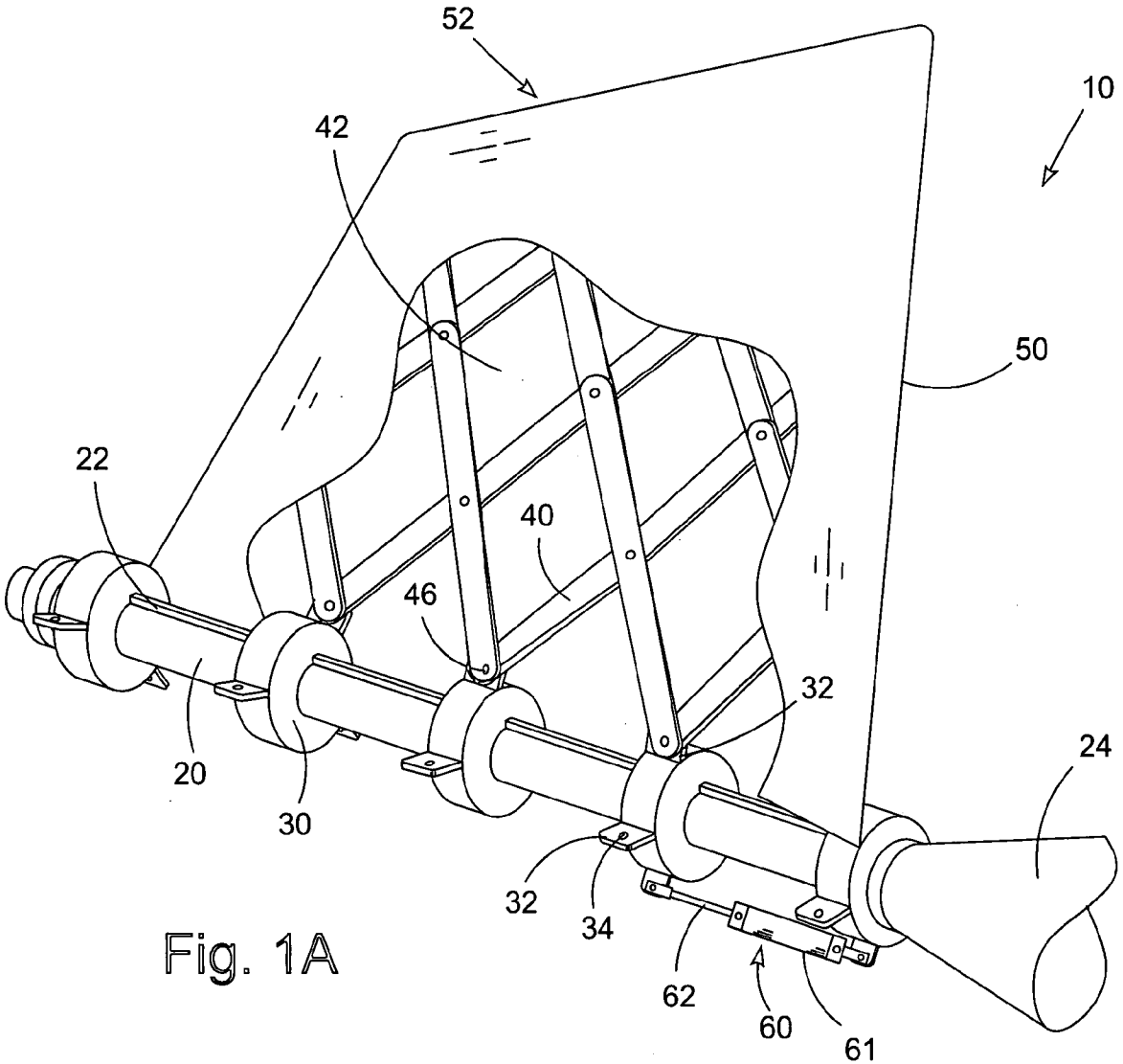
FIG. 1A is a perspective view of the propeller shown in FIG. 1 with a flexible member covering the folding lattice.

FIG. 1A is a perspective view of the propeller 10 shown in FIG. 1 with a flexible member 50 covering the folding lattice 44. In FIG. 1A, folding lattice 44 is covered by flexible membrane 50, forming propeller blade 52. In some embodiments, membrane 50 is urethane. However, it should be readily apparent to one skilled in the art that other flexible materials may be used for membrane 50, and that these materials are within the spirit and scope of the invention as claimed.

Figure 2:
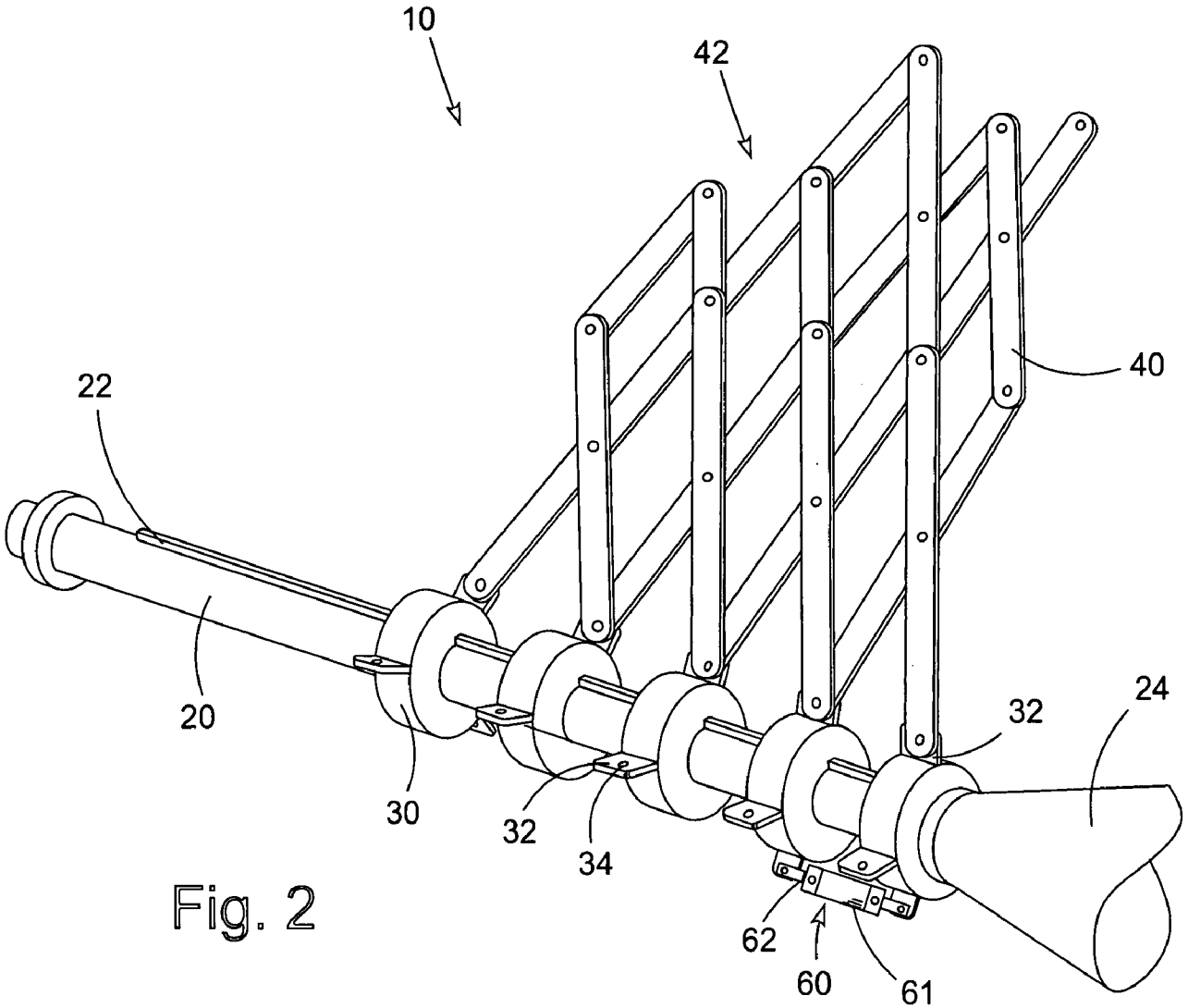
FIG. 2 is a perspective view of the propeller with the folding lattice in a contracted configuration.

FIG. 2 is a perspective view of the propeller with the folding lattice 44 in a contracted configuration. In FIG. 2 actuator 60 is retracted. As a result, collars 30*a* and 30*b* move toward one another, changing the configuration of folding lattice 44. Specifically, the width of lattice 44 in FIG. 2A (measured substantially parallel to the longitudinal axis of shaft 20) decreases and the length of lattice 44 (measured substantially parallel to a radial axis of shaft 20) increases.

Figure 2A:
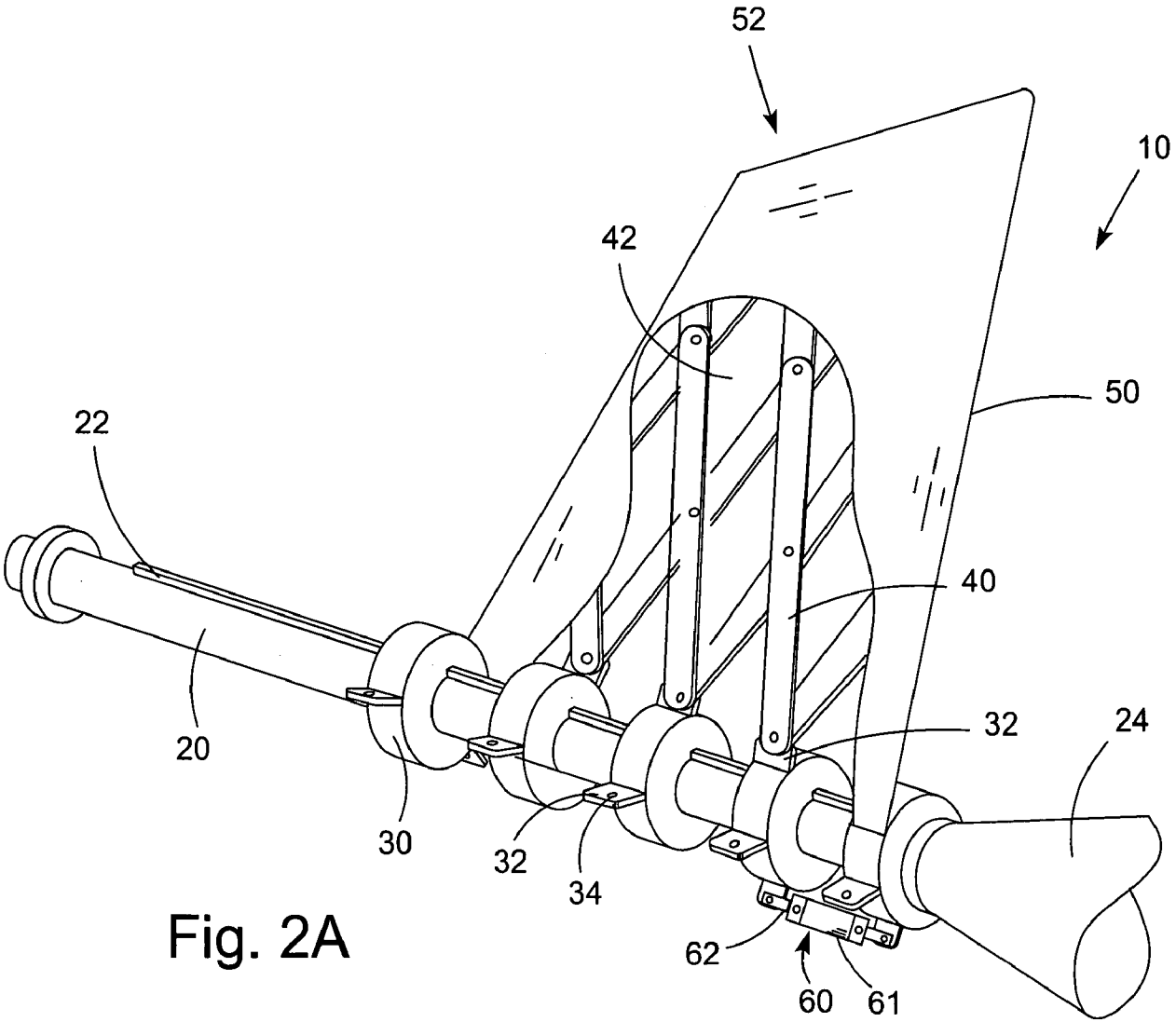
FIG. 2A is a perspective view of the propeller shown in FIG. 2 with a flexible membrane covering the folding lattice.

FIG. 2A is a perspective view of the propeller 10 shown in FIG. 2 with a flexible membrane covering the folding lattice 44.

The following discussion should be considered in light of both FIGS. 1A and 2A. In the retracted aspects, FIG. 2A, and the extended aspects, FIG. 1A, flexible membrane 50 conforms to the shape of folding lattice 44. Flexible membrane 50 may be replaced by a multitude of plates (not shown) attached to folding lattice 44 so as to provide a complete (if not fluid-tight) surface on one or both sides of a blade, in at least two folding lattice 44 positions.

Figure 3:
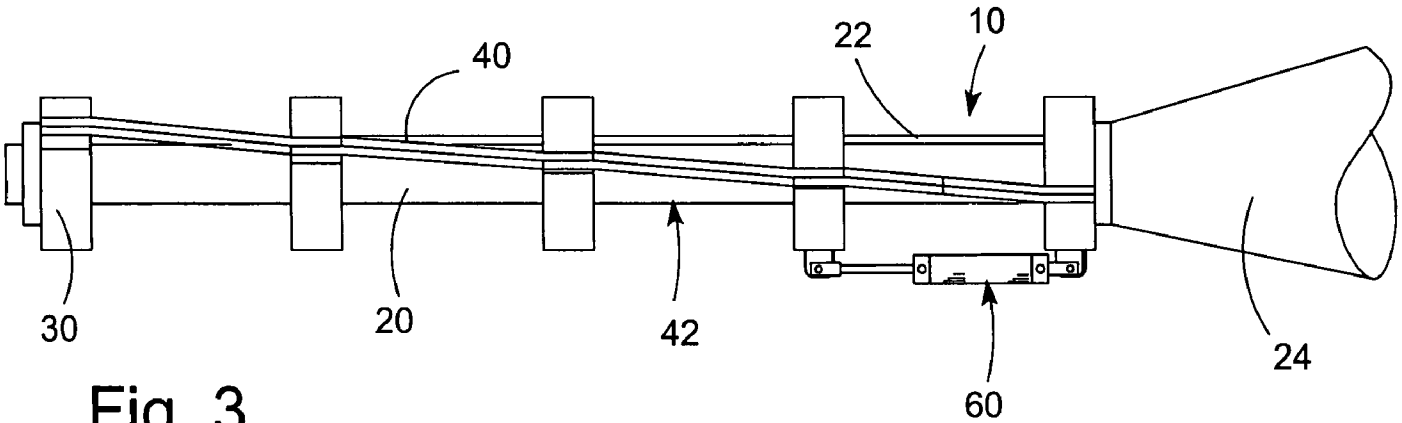
FIG. 3 is a top view of the propeller shown in FIG. 1.

FIG. 3 is a top view of the propeller 10 shown in FIG. 1.

Figure 4:
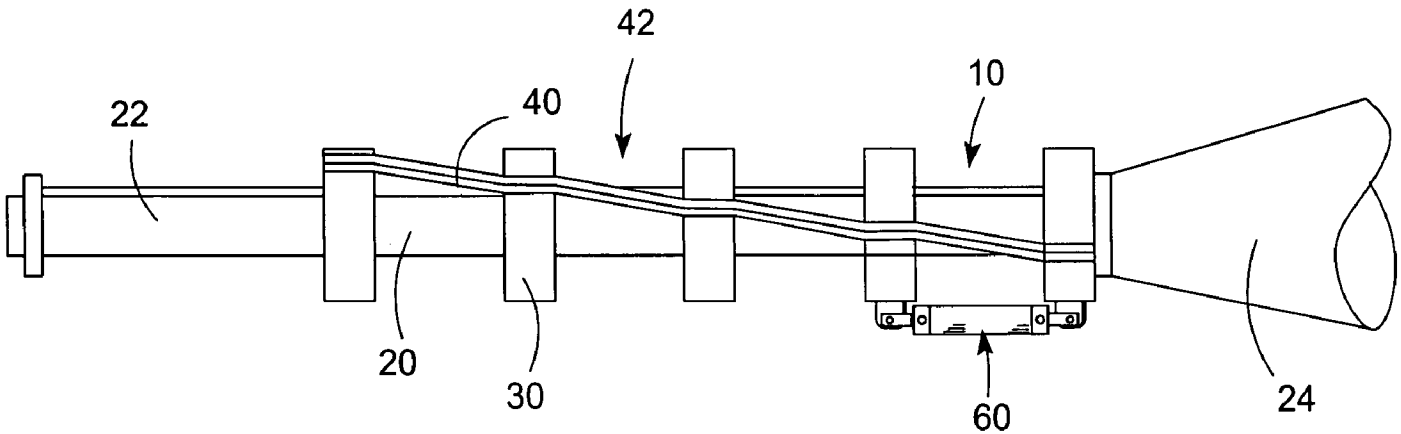
FIG. 4 is a top view of the propeller shown in FIG. 2.

FIG. 4 is a top view of the propeller 10 shown in FIG. 2. The following discussion should be considered in light of FIGS. 1 through 4. FIGS. 3 and 4 illustrate the radial spacing of extensions 32 about successive collars 30 on shaft 20. For example, moving front right to left in FIG. 3, collar extensions 32 on successive collars 30 are positioned further clockwise looking from the right hand end of shaft 20. One propeller blade is shown in FIGS. 1–4 for simplicity. However, it should be readily apparent to one skilled in the art to include multiple blades to construct a full propeller.

Figure 5A:
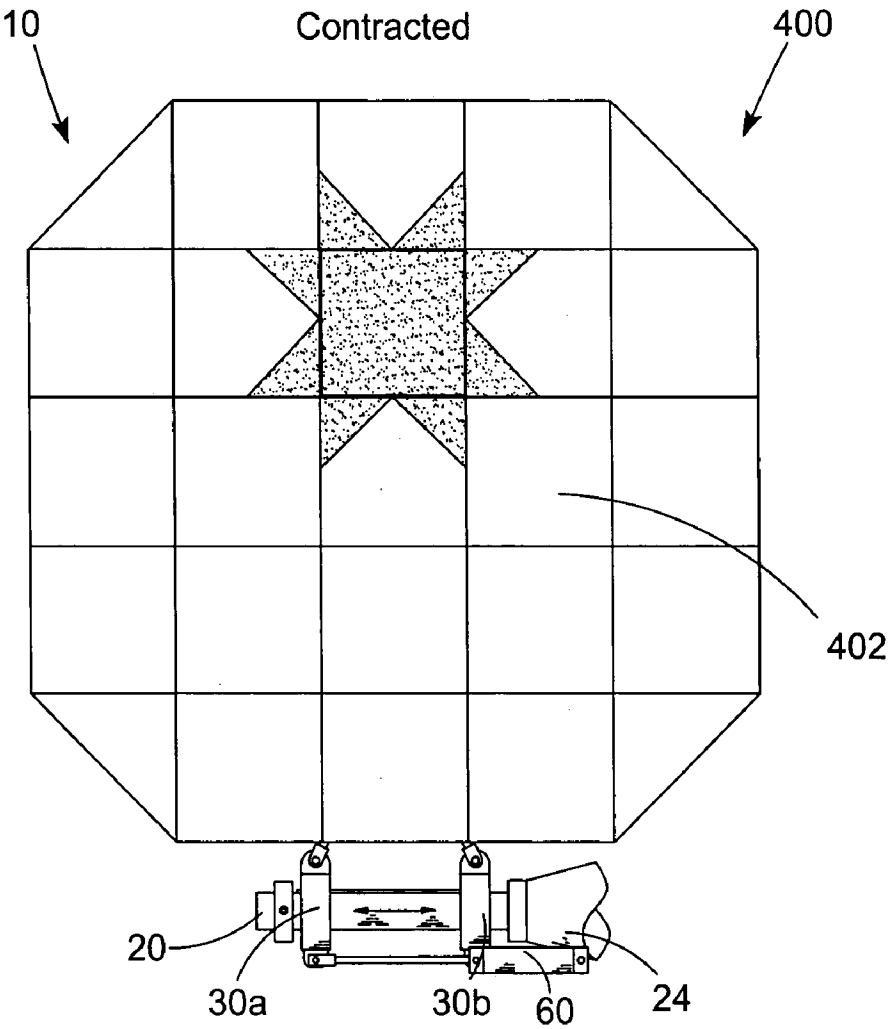
FIG. 5A is an expanded or flattened view of a second embodiment of the propeller in a contracted configuration.

FIG. 5A is an expanded or flattened view of a second embodiment of the propeller 10 in a contracted configuration.

Figure 5B:
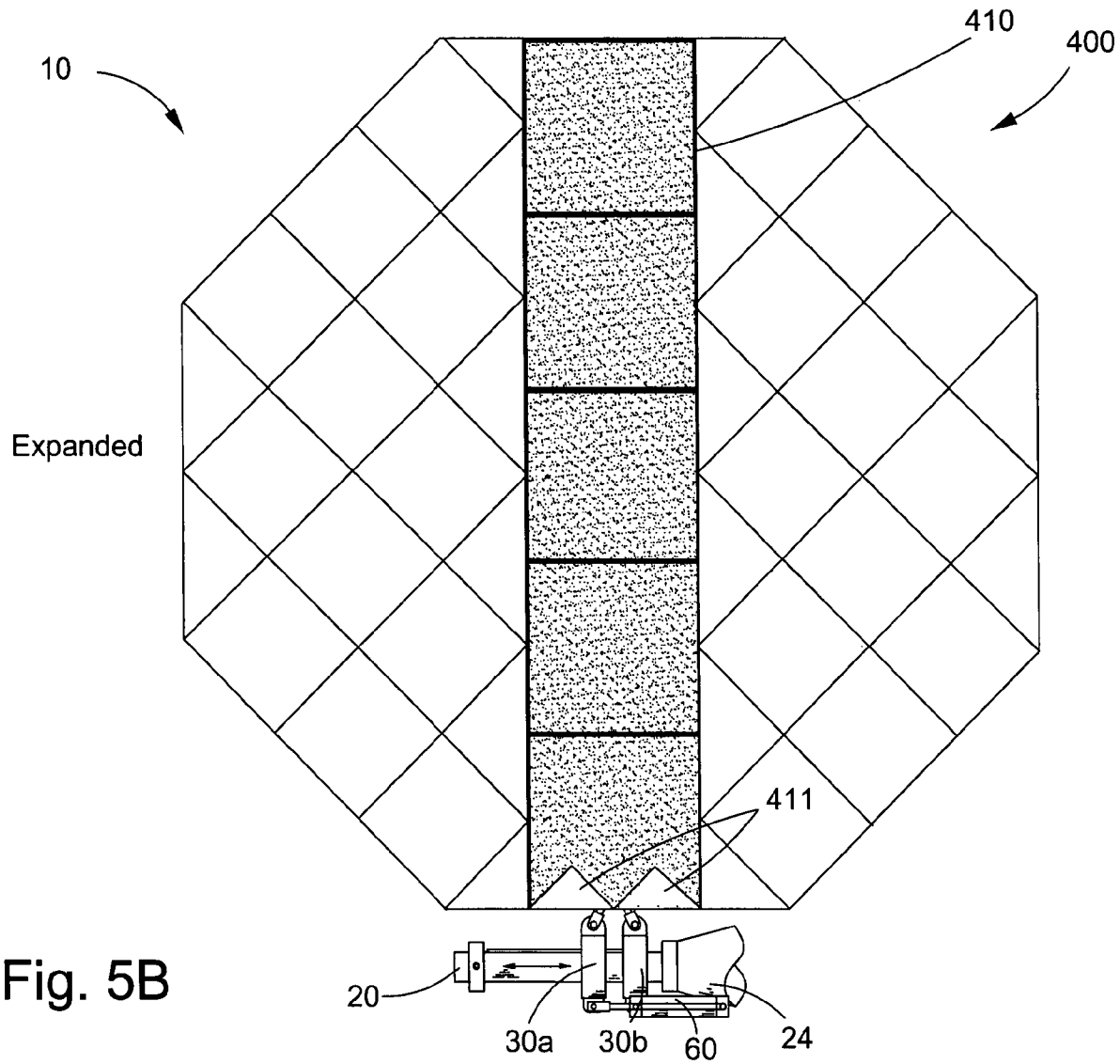
FIG. 5B is an expanded view of the second embodiment in an expanded configuration.

FIG. 5B is an expanded view of the second embodiment in an expanded configuration. The following description should be considered in light of FIGS. 5A and 5B. In FIG. 5A, expandable blade 400 is shown in a contracted configuration. In this configuration, blade 400 consists of a plurality of contracted areas 402. Each of areas 402 has four pairs of plates. These pairs of plates partially overlap, as will be more fully described below. The plates are fully described below, however, to give a simplified overview of the areas 402, plates for only one area 402 are shown. However, it is understood that the following description applies to each of areas 402 in blade 400. The plates noted in the previous sentence are not labeled and boundaries between individual plates are not shown. Instead, only the outline of the plates is shown. Note that portions of the plates overlap into neighboring areas 402. Each area 402 is associated with a truss structure (not shown, but described further below). The plates shown in FIG. 5A are connected to a respective truss.

Blade 400 is connected to collars 30*a* and 30*b*.

FIG. 5B shows blade 400 in the expanded configuration. In this configuration, blade 400 is made up of a plurality of expanded areas 410. Each area 410 corresponds to an area 402. To aid in understanding the transformation of areas 402 to areas 410, five areas 410 are shaded in FIG. 5B. The second area 410 from the top of the page for FIG. 5B corresponds to area 402 in FIG. 5A. To form an area 410, a truss associated with a respective area 402 is expanded, as shown below. The force for this expansion is provided by the movement of collars 30*a* and 30*b* as is described below, and/or by rotation of any number of adjacent truss elements. As a result, the plates rotate and shift position, resulting in the plates occupying a greater area as shown in FIG. 5B. Only the outline of the plates is shown in FIG. 5B. The process also works in the reverse direction. That is, the above-mentioned truss can be contracted, causing the plates to rotate and shift position, resulting in the plates occupying a smaller area. A respective area 410 has approximately twice the surface area of a respective area 402.

Figure 6A:
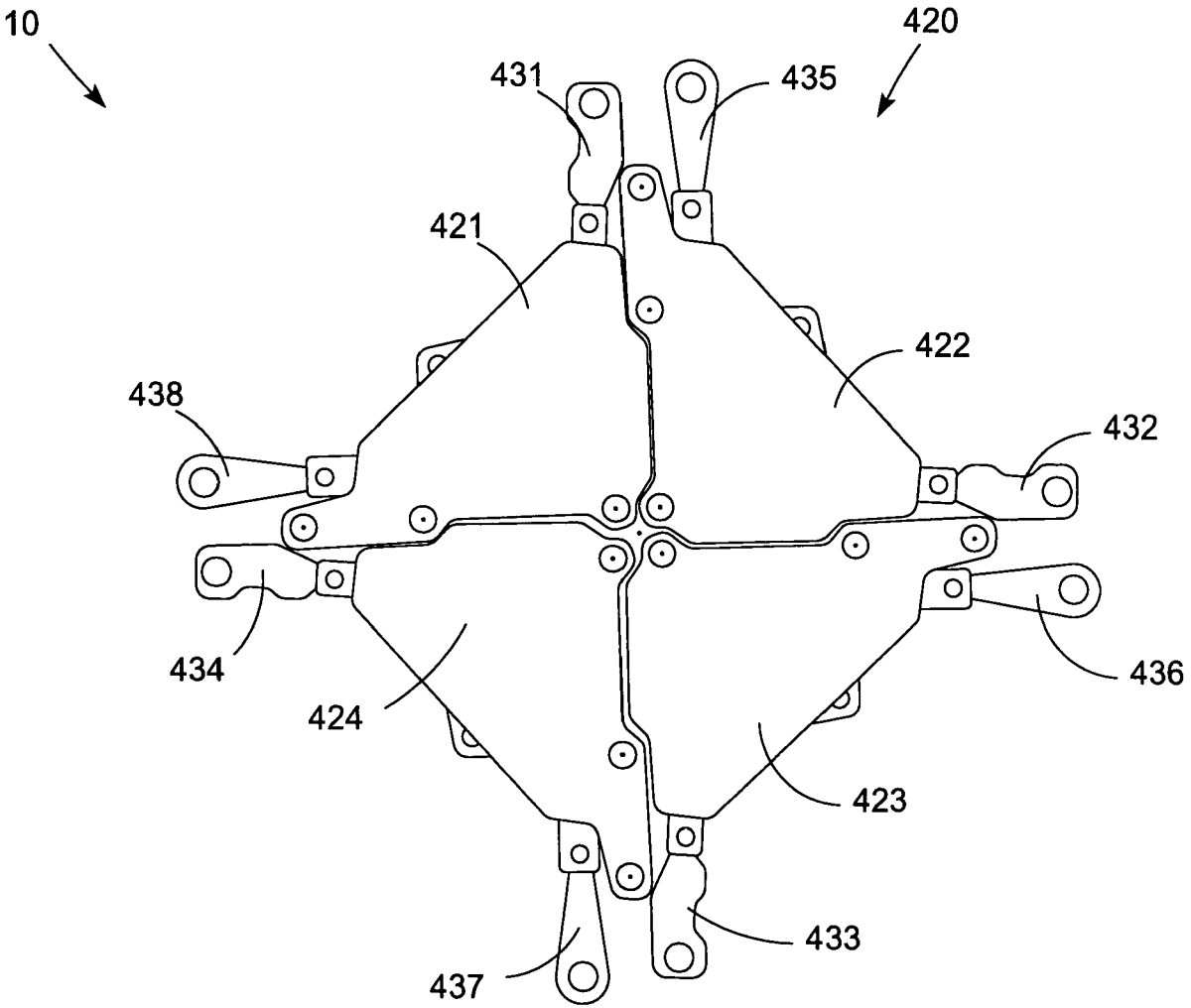
FIG. 6A is a front view of a truss for the second embodiment in a contracted configuration.

FIG. 6A is a front view of a truss 420 for the second embodiment in a contracted configuration.

Figure 6B:
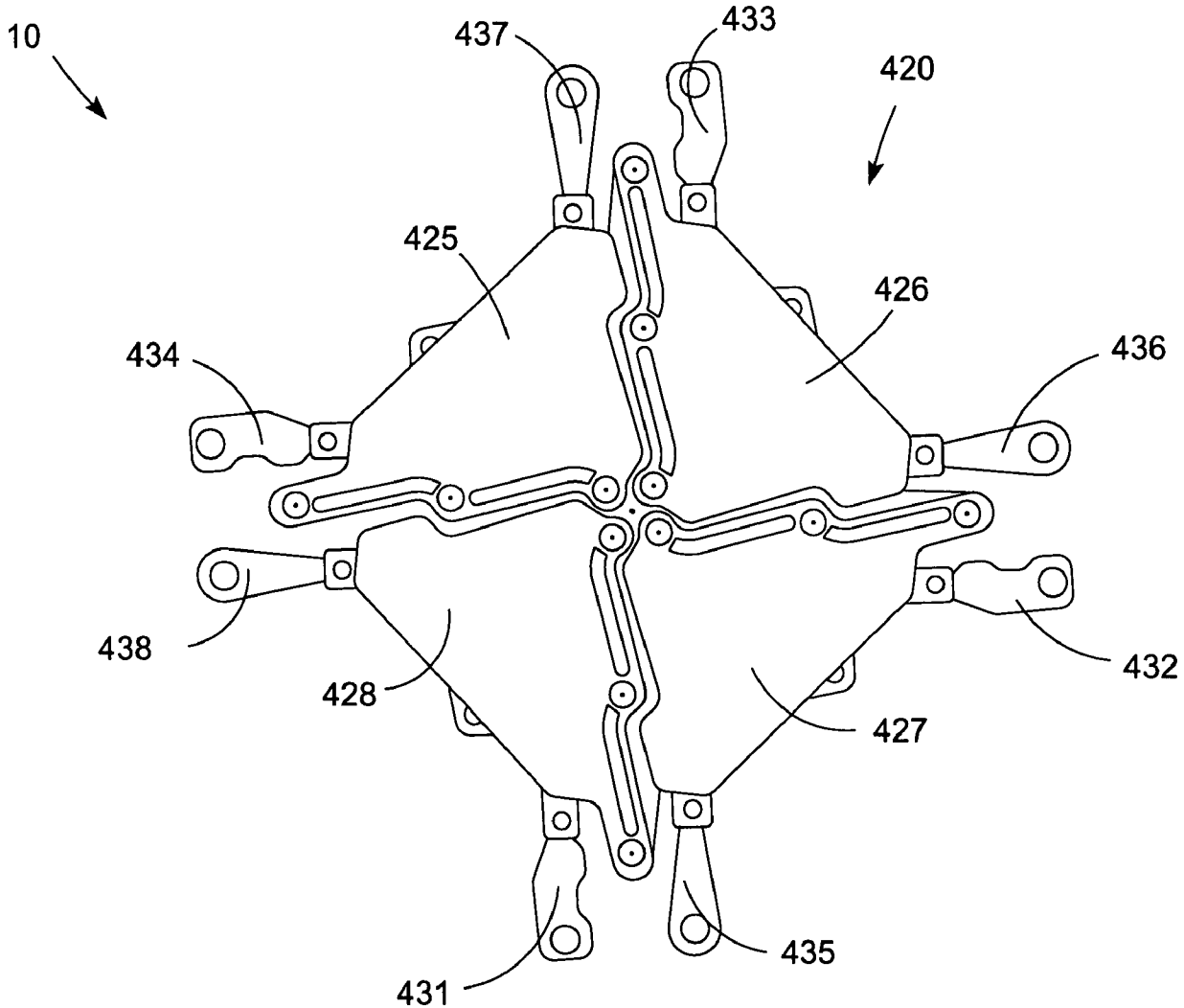
FIG. 6B is a back view of the truss for the second embodiment in a contracted configuration.

FIG. 6B is a back view of the truss 420 for the second embodiment in a contracted configuration. The following should be considered in light of FIGS. 5A, 5B, 6A, and 6B. For each area 402 or area 410, the respective truss noted above is formed by radial extension/retraction truss structure 420. The truss structure 420 may be a radial extension/retraction truss structure as disclosed by U.S. Pat. No. 5,024,031 (Hoberman). FIG. 6A shows the front of truss 420 and FIG. 6B shows the back. It should be understood that the terms "front" and "back" are relative and therefore, fully interchangeable. Mounting members 421 through 424 are shown in FIG. 6A and mounting members 425 though 428 are shown in FIG. 6B. The above-described pairs of plates are securely attached, one plate each, to a corresponding mounting member as is further described below.

Figure 6C:
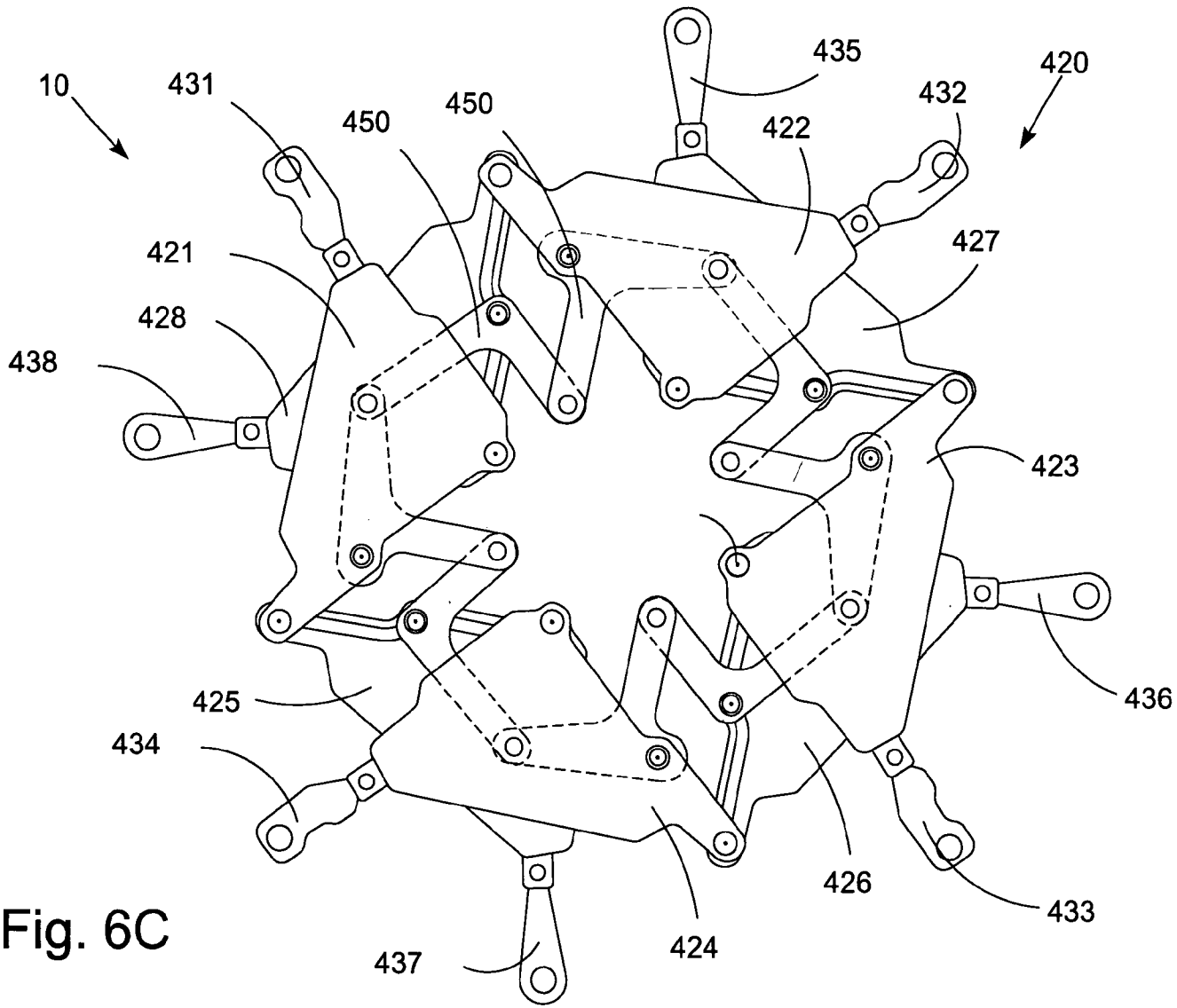
FIG. 6C is a front view of the truss in a partially expanded/contracted configuration.

FIG. 6C is a front view of the truss 420 in a partially expanded/contracted configuration.

Figure 6D:
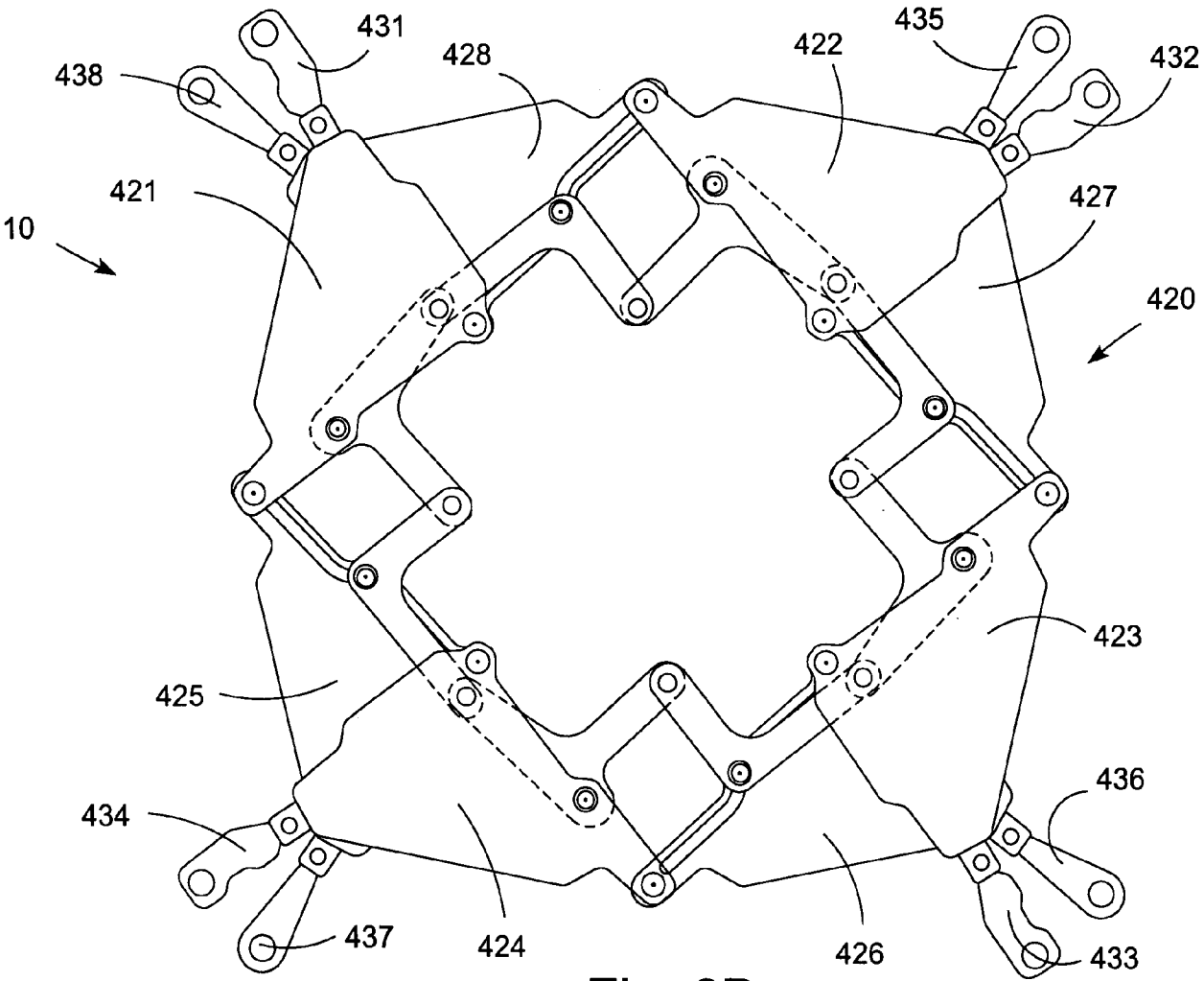
FIG. 6D is a front view of the truss in an expanded configuration.

FIG. 6D is a front view of the truss 420 in an expanded configuration. The following should be considered in light of FIGS. 5A, 5B, 6A, 6C, and 6D. In FIGS. 6C and 6D, the front side of truss 420 is shown. However, it is understood that the description that follows is applicable to the backside of truss 420 also. Mounting members 421 through 428 are connected to linking members 450. Blade link points 431 through 434 are attached to mounting members 421 through 424, respectively. Blade link points 435 through 438 are attached to mounting members 425 through 428, respectively. Truss 420 expands and contracts due to the movements of linking members 450 in FIGS. 6C and 6D. To focus the present description on the essentials of the present invention, only a cursory explanation of the movement of linking members 450 is provided. The reader is referred to the incorporated patent for further details. Linking members 450 and the mounting members each form a closed loop and have pivoting connection points and pivoting/slotted connections points, enabling the mounting members to execute the relatively complex movements shown in FIGS. 6C and 6D.

Linking members 450 move in response to movement of blade link points 431 through 438. For example, blade link points 433 and 436 could be connected to the collars as shown in FIGS. 5A and 5B. Then, as the collar link points are moved progressively closer, blade link points 433 and 436 move closer together, causing linking members 450 to pivot, slide, and move further apart with respect to one another. This results in the mounting members rotating and translating through space to realign in the expanded configuration shown in FIG. 6D. Thus, the plates attached to the mounting members shift from the configuration shown in FIG. 5A to the configuration shown in 5B. Moving the collar link points further apart reverses this process.

It should be understood that actuator 60 also could be directly connected to linking members 450 (not shown). A rotational actuator may be similarly powered to rotate any adjacent or set of adjacent linking members 450 at their common pivot points. In addition, a multiplicity of actuators can be used and combinations of linear and rotational actuators also are possible.

Figure 7:
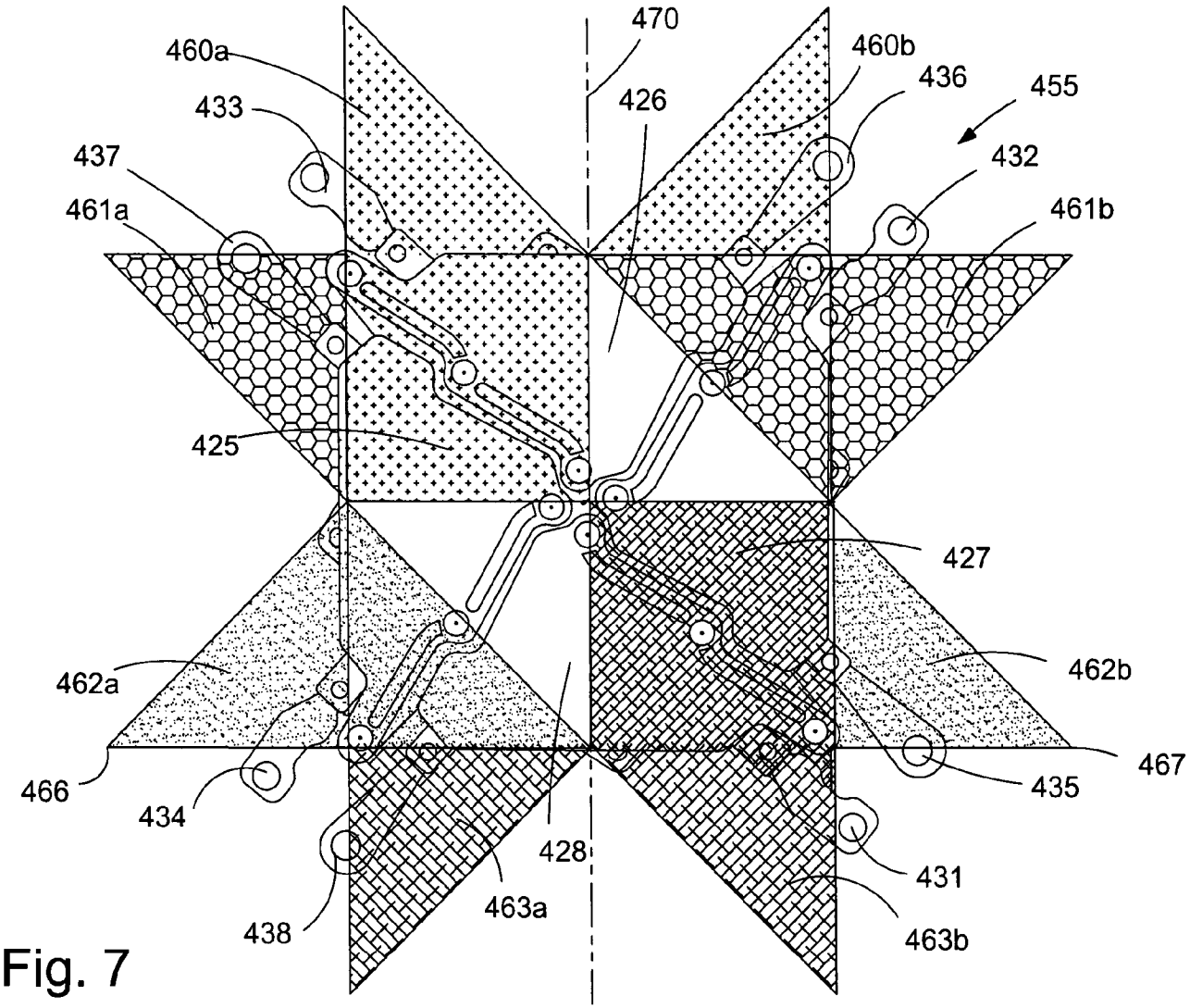
FIG. 7 is a back view of a plate assembly, in a contracted configuration, corresponding to the area shown in FIG. 5A; and, FIG. 8 is a back view of the plate assembly, in an expanded configuration, corresponding to the area shown in FIG. 5B.

FIG. 7 is a back view of a plate assembly 455, in a contracted configuration, corresponding to the area 402 shown in FIG. 5A. The following discussion should be considered in light of FIGS. 5A, 6A, 6B, and 7. The two plates in each of the four pairs of plates noted in the descriptions for FIG. 5A are matched in size and shape. However, it should be readily apparent to one skilled in the art that the sizes and shapes need not be matched, and that such variation in sizes and shapes are within the spirit and scope of the invention as claimed. For each pair, one plate is securely attached to a mounting plate on the front side of truss 420 and the remaining plate is securely attached to a mounting plate on the back side of truss 420, as is further described below. A back side of truss 420 is shown in FIG. 7, although it is understood that a front side could also be shown for the following description. The first pair of plates includes plates 460*a* and 460*b*, roughly trapezoidal in shape. Plate 460*a* is attached to mounting member 426 and plate 460*b* is attached to mounting member 421 (not shown). The second pair includes plates 461*a* and 461*b*, roughly triangular in shape. Plate 461*a* is attached to mounting member 424 (not shown) and plate 460*b* is attached to mounting member 427. The third pair includes plates 462*a* and 462*b*, roughly triangular in shape. Plate 462*a* is attached to mounting member 425 and plate 462*b* is attached to mounting member 422 (not shown). The fourth pair includes plates 463*a* and 463*b*, roughly trapezoidal in shape. Plate 463*a* is attached to mounting member 423 (not shown) and plate 463*b* is attached to mounting member 428.

For those trusses 420 connected to collar link points, a modification (not shown) may be made for plates 463*a* and 463*b*. The portions of plates 463*a* and 463*b* below the line between points 466 and 467 are eliminated to prevent these portions from interfering with the operation of the shaft 20 and collars 30. As a result, there are two gaps 411 in FIG. 5B, for each respective area 410. Each gap 411 is approximately the size of the portion of plate 463*a* or 463*b* below the line between points 466 and 467, and may be closed with a flexible fabric or with attachments on the shaft itself.

Each pair of plates in FIG. 7 is symmetrical with respect to axis of symmetry 470. For example, the portions of plate 460*a*, not visible in FIG. 7 because plate 460*a* is mounted to the front side of truss 420, are positioned in a mirror image of the portions of plate 460*b* that are visible in FIG. 7. There is overlapping of the plates in FIG. 7. For example, portions of plate 461*a* overlap portions of plate 460*a* and portions of plate 460*b* overlap portions of plate 461*b*. The thickness, or distance between the front and back sides, of truss 420 helps provide the separation between overlapping plates needed for respective plates to slide over and past one another, as described below. The thickness may be tailored on individual assemblies and overlap sides varied to better approximate a typical foil cross-section to the propeller blade.

Multiple assemblies 455 are connected to form blade 400 shown in FIGS. 5A and 5B. To do this, pivotal connections are made at corresponding blade link points. For example, for an assembly 455 (not shown) positioned to the left of assembly 455 in FIG. 7, blade link points 435 and 432 would be pivotally connected to blade link points 434 and 437 for assembly 455 in FIG. 7.

Figure 8:
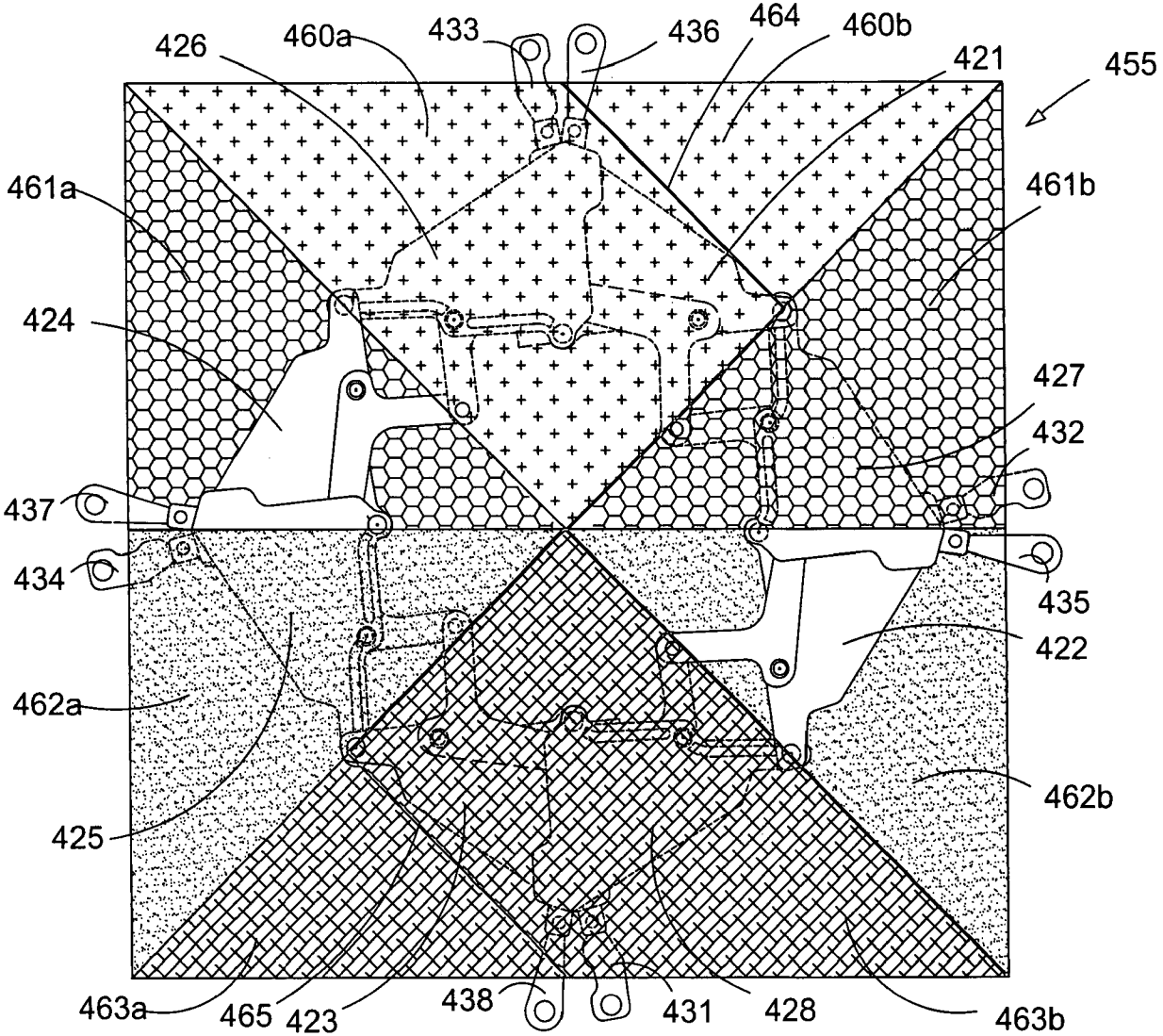

FIG. 8 is a back view of the plate assembly 455, in an expanded configuration, corresponding to the area 410 shown in FIG. 5B. The following discussion should be considered in light of FIGS. 5B, 6D, 7, and 8. FIG. 8 shows the disposition of the plates described in FIGS. 7 after truss 420 is moved to the expanded position shown in FIG. 6D. In FIG. 8, the plates present the greatest surface area. There is no overlapping between plates 461*a* and 461*b* and plates 462*a* and 462*b*. Plates 460*a* and 460*b* and plates 463*a* and 463*b*, respectively, partially overlap. In FIG. 8, all of plate 460*a* is visible, and line 464 shows the overlap between plates 460*a* and 460*b*. In FIG. 8, all of plate 463*b* is visible, and line 465 shows the overlap between plates 463*a* and 463*b*.

The following should be considered in light of FIGS. 5A through 8. It should be understood that the truss 420 can have more or less than the four pairs of linking members 450 and associated mounting members shown in FIGS. 6A through 6D. For example, truss 420 could have three, five, or six pairs of linking members 450 and three, five, or six pairs of associated mounting members, respectively. It also is understood that the number of plates can vary accordingly. For example, in the previous example, a respective assembly 455 could have three, five, or six pairs of overlapping plates.

The present invention can be applied to a number of propeller or blade applications. For example, the present invention can be used in applications providing propulsion for transportation units including, but not limited to, aircraft, waterborne vessels, and submersible vessels. In addition, the present invention can be used in rotational fans or blowers.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A propeller comprising:

a blade assembly having a plurality of linking members operatively connected to one another, where at least two of said linking members are pivotally connected one to the other;

a blade surface engaged with said blade assembly, covering at least a portion of said blade assembly, and operatively arranged to change shape when said linking members are moved with respect to one another a propeller shaft; and, a plurality of collars, each collar in said plurality of collars radially surrounding said shaft, operatively arranged to slide longitudinally along said shaft while remaining rotationally fixed about said shaft, and having a collar link point; and, wherein said blade assembly includes a plurality of blade link points pivotally connected to respective collar link points.

2. The propeller recited in claim 1 wherein said shaft further comprises an end; and, wherein each successive collar in said plurality of collars:

is positioned further from said end than a preceding collar; and, has a collar link point at a greater radial angle from a radial axis for said shaft than a collar link point for said preceding collar.

3. The propeller recited in claim 1 further comprising:

an actuator operatively connected to at least two collars in said plurality of collars; wherein said actuator operates to vary a longitudinal distance between said at least two collars along said shaft; and, wherein said linking members move with respect to one another in response to varying said distance between said collars.

4. The propeller recited in claim 3 wherein said actuator is selected from a group of actuators consisting of pneumatic actuators, hydraulic actuators, and micro-electrical mechanical systems.

5. The propeller recited in claim 3 wherein said plurality of linking members further comprises a plurality of lattice bars; and, wherein each lattice bar has a plurality of connection points in a straight line and said plurality of lattice bars are pivotally connected to one another at said connection points; and, wherein said blade assembly further comprises a folding lattice.

6. The propeller recited in claim 5 wherein at least two lattice bars in said plurality of lattice bars have blade link points; and, wherein each of said at least two lattice bars is connected, respectively, to one of said respective collar link points.

7. The propeller recited in claim 5 wherein said blade surface comprises a flexible material conforming to a shape of said folding lattice and covering said folding lattice.

8. The propeller recited in claim 7 wherein said flexible material comprises urethane.

9. The propeller recited in claim 1 wherein said propeller is connected to a waterborne vessel.

10. The propeller recited in claim 1 wherein said propeller is connected to a submersible vessel.

11. A propeller comprising:

a blade assembly having a truss structure, a blade surface engaged with said blade assembly, covering at least a portion of said blade assembly, wherein said truss structure further comprises a radial expansion and retraction structure having:

a plurality of linking members pivotally connected to one another to form a closed loop; and, a plurality of mounting members pivotally connected to one another to form a closed loop and pivotally and slidingly connected to corresponding linking members; and, wherein each of said mounting members has a blade link point, wherein said blade surface varies in size as said blade link points are moved with respect to one another, and wherein said blade surface is operatively arranged to change shape when said linking members are moved with respect to one another.

12. The propeller recited in claim 11 further comprising:

a propeller shaft; and, a plurality of collars, each collar in said plurality of collars radially surrounding said shaft, operatively arranged to slide longitudinally along said shaft while remaining rotationally fixed about said shaft, and having a collar link point; and, wherein at least two of said blade link points are pivotally connected to first respective collar link points.

13. The propeller recited in claim 12 wherein said shaft further comprises an end; and, wherein each successive collar in said plurality of collars:

is positioned further from said end than a preceding collar; and, has a collar link point at a greater radial angle from a radial axis for said shaft than a collar link point for said preceding collar.

14. The propeller recited in claim 12 further comprising:

an actuator operatively connected to at least two collars in said plurality of collars; wherein said actuator operates to vary a longitudinal distance between said at least two collars along said shaft; and, wherein said blade surface varies in size in response to varying said distance between said at least two collars.

15. The propeller recited in claim 14 wherein said actuator is selected from a group of actuators consisting of pneumatic actuators, hydraulic actuators, and micro-electrical mechanical systems.

16. The propeller recited in claim 14 wherein said blade surface comprises a flexible material conforming to a shape of said radial expansion and retraction structure and covering said radial expansion and retraction structure.

17. The propeller recited in claim 16 wherein said flexible material comprises urethane.

18. The propeller recited in claim 14 wherein said blade surface further comprises a plurality of overlapping plates having a surface area, each plate in said plurality of overlapping plates fixedly connected to a corresponding mounting member in said plurality of mounting members; and, wherein said surface area varies in size in response to varying said distance between said at least two collars.

19. The propeller recited in claim 18 wherein said plurality of mounting members further comprises four pairs of overlapping mounting members;

wherein blade link points for one pair of said four pairs of overlapping mounting members are pivotally connected to second corresponding collar link points; and, wherein said surface area decreases in size as said second corresponding collar link points are moved further apart and increases in size as said second corresponding collar link points are moved closer together.

20. The propeller recited in claim 19 wherein for each pair of members in said four pairs of overlapping mounting members, a first mounting member is a part of a front surface for said blade assembly structure and a second mounting member is a part of a back surface for said blade assembly structure;

wherein said plurality of overlapping plates further comprises four pairs of plates; and, wherein for each pair of said four pairs of plates, a first plate is connected to a respective said first mounting member and a second plate is connected to a respective said second mounting member.

21. The propeller recited in claim 20 wherein for said each pair in said four pairs of plates, both plates have a same shape.

22. The propeller recited in claim 21 wherein for two pairs of said four pairs of plates, said plates are approximately triangular in shape; and, wherein for a remaining two pairs of said four pairs of plates, said plates are approximately trapezoidal in shape.

23. The propeller recited in claim 20 wherein said blade assembly further comprises a plurality of radial expansion and retraction structures.

24. A method for varying dimensions of a propeller comprising:

operatively connecting a plurality of linking members to form a blade assembly;

moving said linking members with respect to one another, where for two linking members in said plurality of linking members, said moving is a pivoting movement;

covering at least a portion of said blade assembly with a blade surface; and, changing a shape for said blade surface in response to moving said linking members, wherein the propeller further comprises a shaft, and radially surrounding the shaft, a plurality of collars; and, wherein the method further comprises:

operatively connecting said blade surface and said plurality of collars;

sliding said collars along said shaft to vary a distance between said collars; and, changing said shape of said blade surface in response to sliding said collars.

25. The method recited in claim 24 wherein said propeller further comprises a linear actuator; and, wherein the method further comprises:

operatively connecting said actuator to at least two collars in said plurality of collars; and, wherein changing said shape of said blade surface in response to sliding said collars further comprises operating said actuator to slide said at least two collars.

26. The method recited in claim 24 wherein said propeller further comprises a rotational actuator, and wherein the method further comprises:

operatively connecting said rotational actuator to at least two linking members in said plurality of linking members, and wherein changing a shape for said blade surface in response to moving said linking members includes using said rotational actuator to move said linking members.

* * * * *